US005443024A

United States Patent [19]

Wethington et al.

[11] Patent Number: 5,443,024

[45] Date of Patent: Aug. 22, 1995

[54] POCKET HEMMER

[75] Inventors: Glenn Wethington, Bowling Green; Jimmy D. Claiborne, Scottsville; Mark R. Strain, Alvaton, all of Ky.

[73] Assignee: Union Underwear Company, Inc., Bowling Green, Ky.

[21] Appl. No.: 141,208

[22] Filed: Oct. 26, 1993

[51] Int. Cl.[6] ..... D05B 19/00; D05B 35/02

[52] U.S. Cl. ..... 112/470.05; 112/130; 112/141; 112/304; 112/470.04; 112/470.36; 112/470.02

[58] Field of Search ..... 112/121.11, 141, 143, 112/130, 121.29, 147, 142, 304, 2, 121.27

[56] References Cited

U.S. PATENT DOCUMENTS 3,661,384 5/1972 Morton .
3,898,941 8/1975 Crawford et al. .
3,977,538 8/1976 Crawford et al. .
4,017,064 4/1977 Crawford et al. .
4,176,832 12/1979 Hughes et al. .
4,464,160 8/1984 Joyce .
4,550,670 11/1985 Thompson et al. ..... 112/130 X
4,895,088 1/1990 Pirello et al. ..... 112/130
4,951,586 8/1990 Becherini ..... 112/121.27 X
5,029,537 7/1991 Schramayr et al. .
5,123,367 6/1992 Black et al. .
5,167,197 12/1992 Lavelle et al. ..... 112/130 X

*Primary Examiner*—Peter Nerbun

[57] ABSTRACT

An automatic hemming machine, including a multi-belt conveyor, for folding the top edge of a pocket to be subsequently sewn on a shirt and hemming it with a back binding tape, severing the binding tape sewn on the pockets with a fast acting scissors type trimming assembly, and thereafter stacking a predetermined number of pockets after being fed off of the conveyor and returning one or more stacks in a bundle to an operator who does not have to leave the work station to unload the bundle from the machine.

41 Claims, 9 Drawing Sheets

FIG. 9A
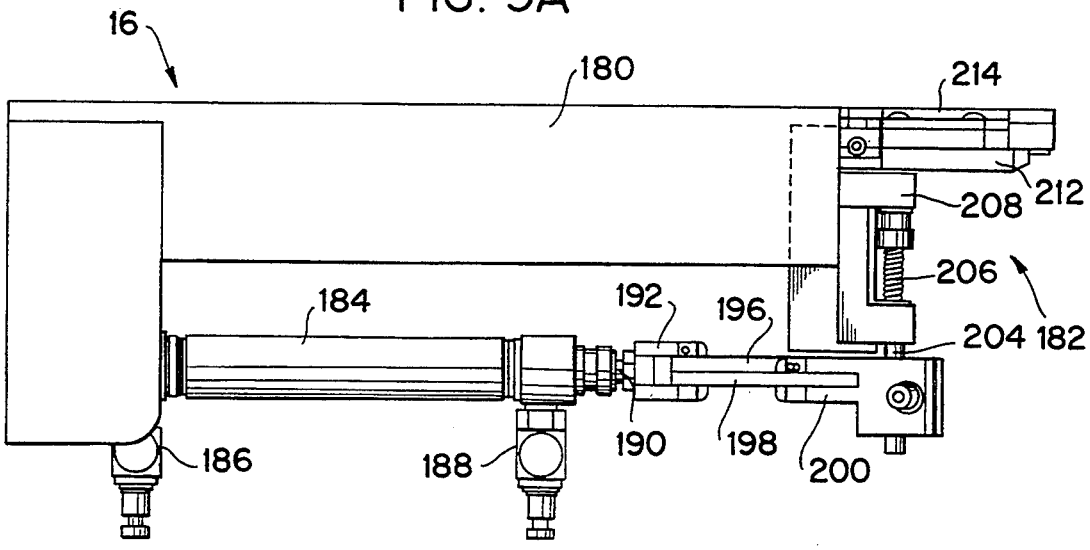
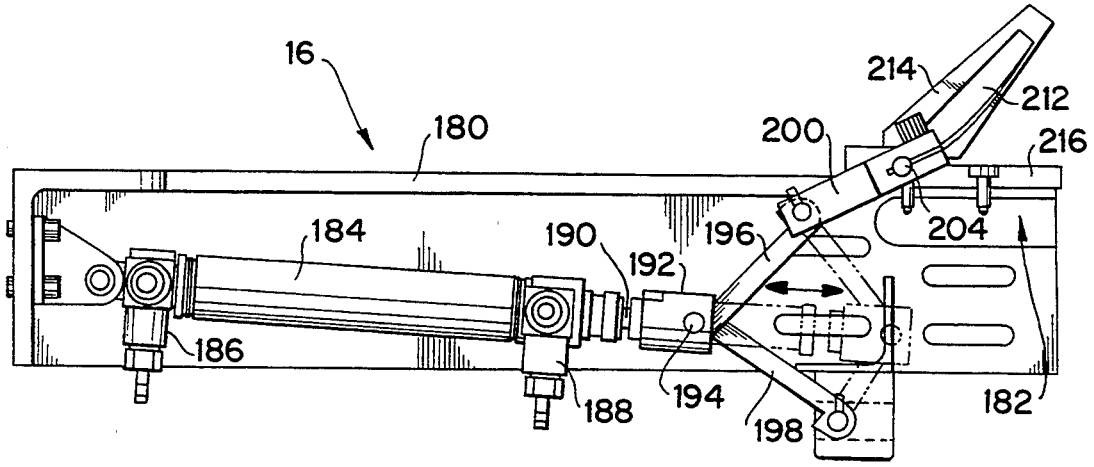
FIG. 9B

POCKET HEMMER

BACKGROUND OF THE INVENTION

This invention relates generally to fabric hemming apparatus and, more particularly, to a conveyor type machine for automatically folding a top edge of a piece of knitted fabric, such as a pocket, and hemming it with a back binding tape, after which the tape is cut and the hemmed fabric pieces stacked and delivered back to an operator.

Hemming machines for automatically producing hemmed fabric pieces, such as pre,processed pockets which are later sewn on the front of a dress shirt, are generally known. Such apparatus typically involves equipment for delivering a pocket piece to a folder section where a hem fold is formed along one edge, which is followed by delivering the pocket with the hem fold to a sewing machine where the fold is simply stitched or a piece of binding tape is sewn to the hem fold. Following the sewing operation, the hemmed pocket, in some instances, is trimmed and then fed to an unloading station where hemmed pockets are removed manually or are automatically accumulated for subsequent removal, for example, in a stack of pre-processed pocket parts.

SUMMARY

It is an object of the present invention, therefore, to provide an improvement in automatic hemming apparatus.

It is another object of the subject invention to provide automatic hemming apparatus having an improved production rate.

It is a further object of this invention to provide automatic hemming apparatus having improved pocket conveying means.

It is still another object of the invention to provide automatic hemming apparatus having improved means for forming and sewing a hem, including a back binding tape, in a pocket being conveyed to and from a sewing head.

It is yet another object of the invention to provide automatic hemming apparatus having improved means for severing a binding tape or chain stitching after being fed out of a sewing head.

It is still a further object of the invention to provide automatic hemming apparatus having improved means for stacking and for feeding hemmed pockets back to an operator.

Briefly, the foregoing and other objects are realized by a hemming machine for folding the top edge of a knitted pocket ply and hemming it with a back binding tape, severing the binding tape on each side of the pocket, and thereafter stacking a predetermined number of pockets after being fed off of a conveyor and returning the stack to an operator who therefore does not have to leave the work station to unload the completed stack of hemmed pockets.

The apparatus includes, inter alia, a lay up section where an operator places individual pocket parts on a main conveyor belt assembly including, in addition to two relatively narrow parallel lower conveyor belts, a pair of relatively narrow opposing intermediate conveyor belts, an upper and lower belt, for holding the pockets in place on a conveyor table. The upper conveyor belt, moreover, is spring biased downwardly against an opposing lower belt member. The upper and lower belt members are slaved together and run at the same speed with the other two belts.

The next section of the apparatus comprises a folder and a binding tape guide which feeds a binding tape from a spool to a sewing section where a sewing head, operating in synchronism with the conveyor belt assembly, sews a portion of the binding tape to the back of the folded pocket body.

This is followed by a section where the binding tape which is continuous between successive sewn pockets, is cut apart. The leading and trailing edge of each pocket is sensed and the binding tape is severed thereat by means of a double acting pneumatically driven scissors type knife assembly. A machine control unit determines when and where to sever the binding tape, such that if the pockets are extremely close, the knife cuts only once between pockets to ensure the slightest margin of binding tape outside of the edge of the pocket; however, if the pockets are separated by more than a predetermined amount, the processor will command the knife to cut twice, thus separately trimming the trailing and leading edges of two successive pockets.

Following the cutting section, the main conveyor assembly feeds the trimmed pockets to a stacker section where sensors mounted on the conveyor table detect the presence of a hemmed pocket which is then transferred from the conveyor table onto a flipper assembly. The presence of a pocket on the flipper assembly is sensed and a flipper element is activated to flip and stack the pocket on a trap door assembly which, when a predetermined number of pockets are counted, the trap doors open and the stack is dropped into a pusher assembly.

The pusher assembly includes a tray, pusher plate and pneumatic actuator which is activated after one or more stacks are present to push the bundle onto a return conveyor.

The section including the return conveyor includes a relatively wide conveyor belt fabricated of a predetermined material which transports the finished bundle back to the operator, but has a selective coefficient of friction so as to slide under a stack of pockets when the stack meets an end stop located adjacent the operator.

BRIEF DESCRIPTION OF THE DRAWINGS

The following detailed description of the invention will be more readily understood when considered together with the accompanying drawings wherein:

FIGS. 9A and 9B are top plan view and side plan views respectively and being further illustrative of the details of the trimmer knife assembly shown in FIG. 7;

DETAILED DESCRIPTION OF THE INVENTION

Figure 1:
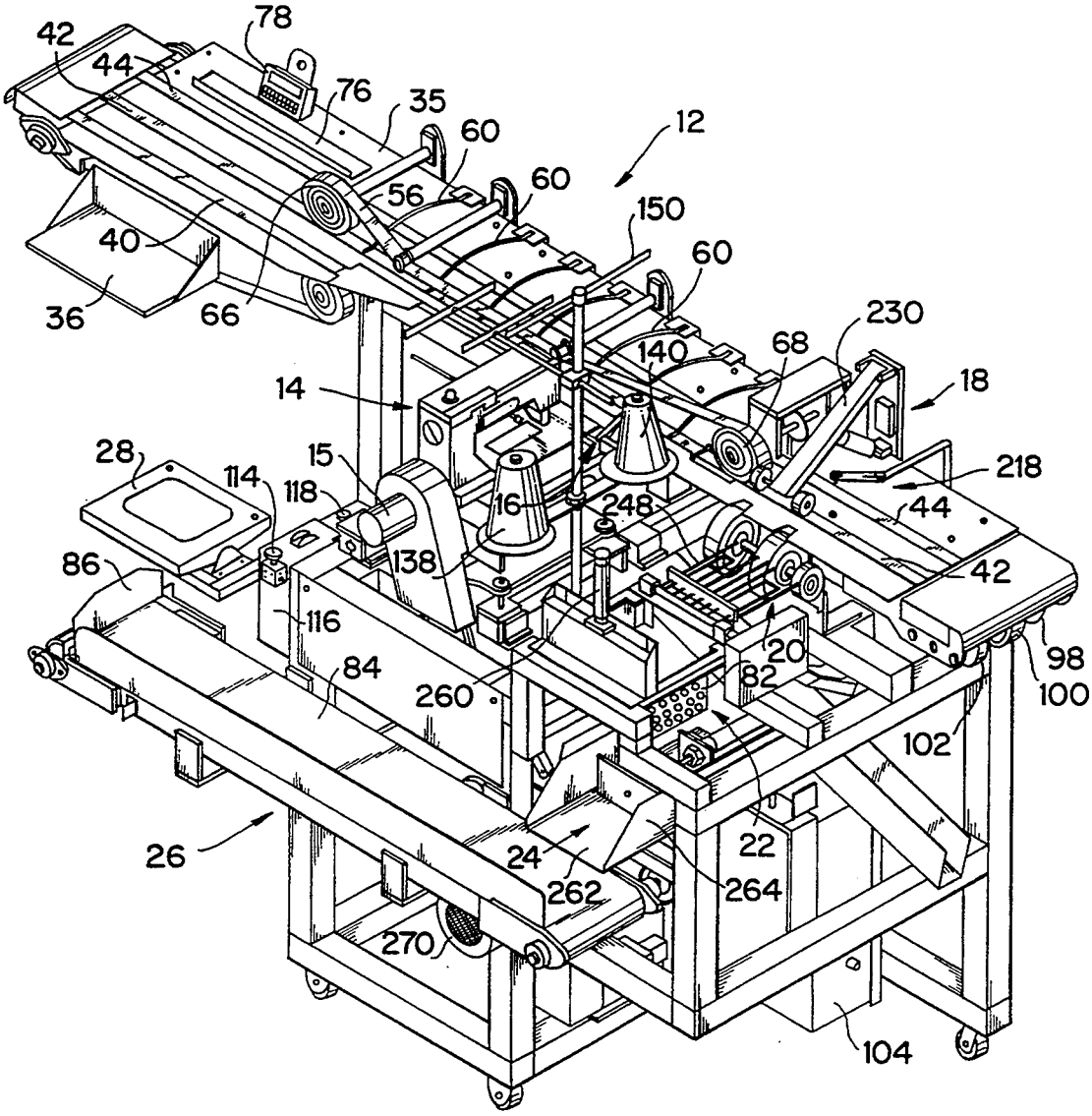
FIG. 1 is a perspective view generally illustrative of the apparatus comprising the subject invention.
Figure 2:
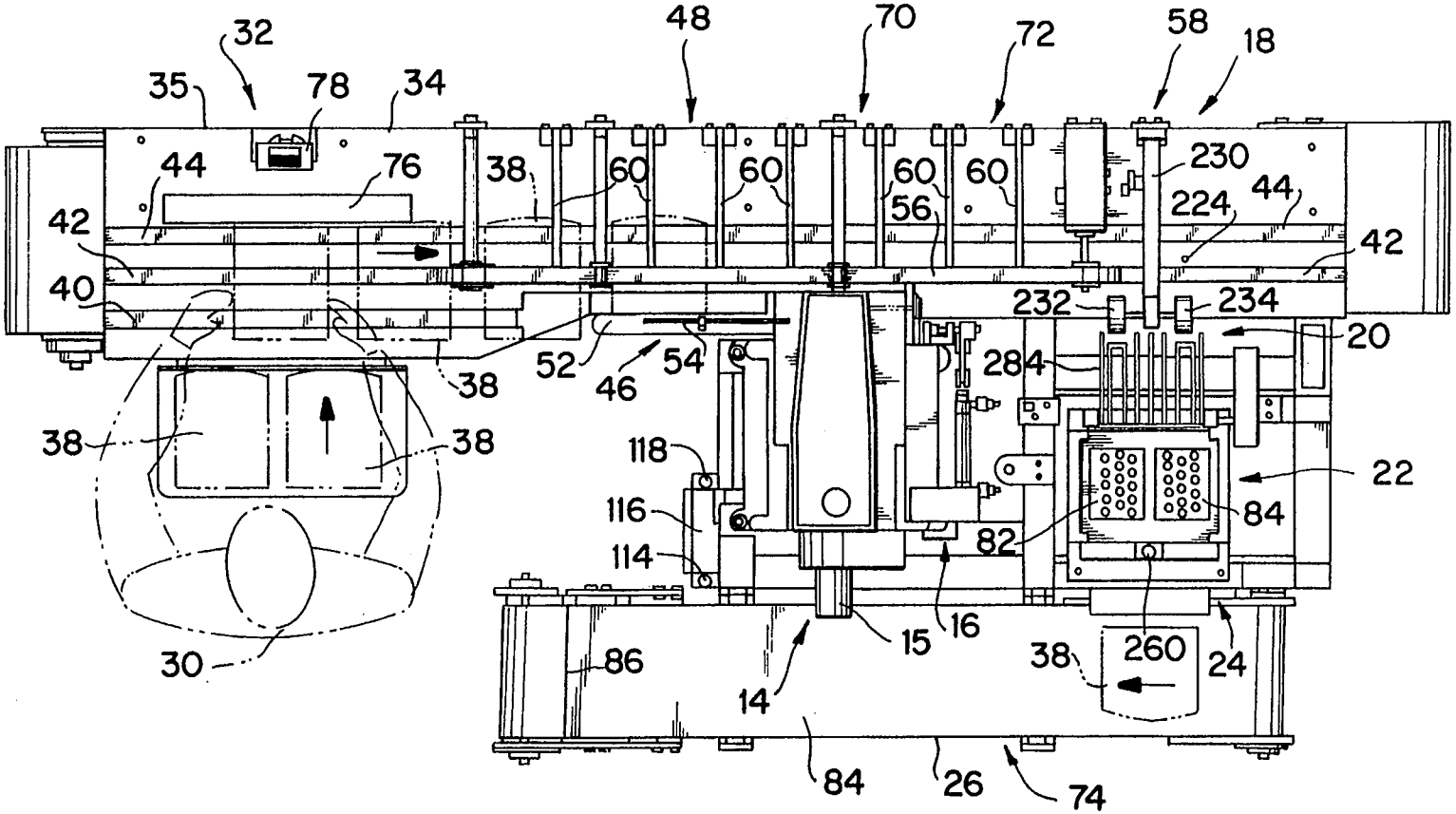
FIG. 2 is a top plan view further illustrative of the apparatus shown in FIG. 1 and further depicting the various sections thereof.
Figure 3:
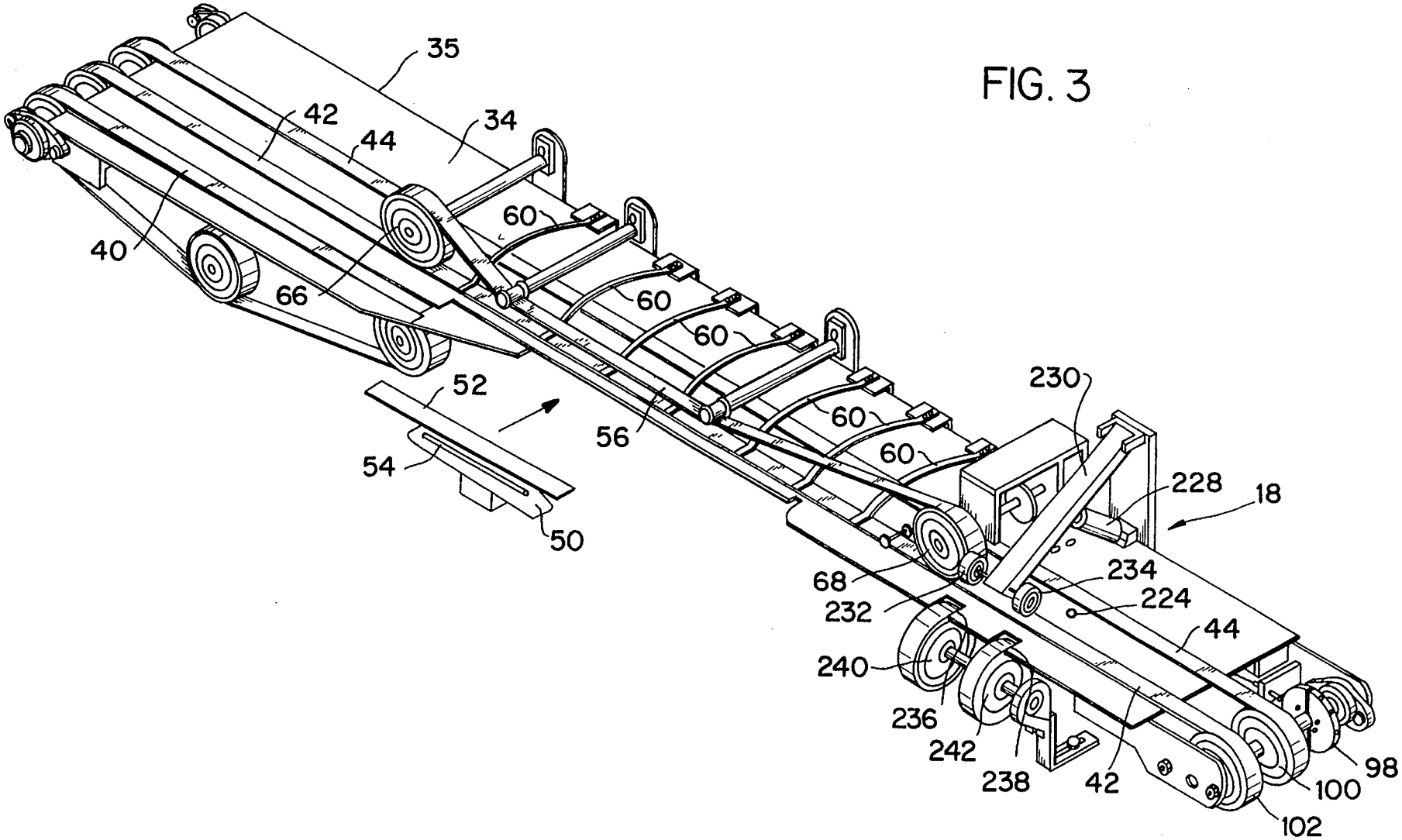
FIG. 3 is a partial perspective view of the main conveyor assembly shown in FIG. 1 including the stacker section thereof.

Referring now to the drawings and first to FIGS. 1–3, FIG. 1 is illustrative of a full view of the preferred embodiment of the invention and which comprises, among other things, a frame 10 which is designed to support a main conveyor belt assembly 12, a sewing head 14, an adjoining pocket trimmer knife assembly 16, a pocket unloader assembly 18, a flipper mechanism 20, a hemmed pocket stack and drop assembly 22, a pusher assembly 24 and a return conveyor 26. The details of these elements will be considered in greater detail as this detailed description progresses.

In addition to the various components mounted on the frame 10, there is a foot pedal 28 which is located near or on the floor at the location of an operator 30 who is positioned at a lay up section 32 of the machine as shown in FIG. 2.

Referring now also to FIG. 2, a conveyor table 34 of a conveyor assembly 35 having a tray 36 attached thereto at the lay up section 32 is adapted to receive a supply of pocket plies or pieces (FIG. 2), preferably rectangular in shape, which the operator manually positions over three relatively narrow conveyor belts 40, 42 and 44 which are arranged parallel to one another and two of which, belts 42 and 44, run the length of the table 34. The remaining belt 40 comprises a relatively shorter belt extending to a folder assembly 46 located at a folder section 48. As shown in FIG. 1, the folder assembly 46 is comprised of two adjacent elongated plate members 50 and 52 which are additionally shown in FIG. 4 and between which is located an elongated pneumatic tube fed from an air supply, not shown.

Beginning at the folder section 48, there is an upper conveyor belt 56 which overlays the middle conveyor belt 42 and extends to a stacker section 58 at the far end of the conveyor table 34. The lower portion of the upper conveyor belt 56 is furthermore biased downwardly over the lower conveyor belt 42 by a plurality of substantially equally spaced spring tensioned hold-down members 60. The upper portion of the top belt 56 is also urged downwardly by a pair of idler roller sub-assemblies 62 and 64 which overlay the table 34 and are located between a pair of relatively larger idler rollers 66 and 68, one of which, i.e. roller 68, is driven in a manner to be explained hereinafter.

Adjacent the upper conveyor belt 56 between the folder section 48 and the stacker section 58, is a hemming section 70, as shown in FIG. 2, which includes the sewing head 14 and a separation section 72 which includes the trimmer knife assembly 16. The stacker section 58 includes the unloader assembly 18, flipper assembly 20, and stacker and dropper assembly 22, beneath which is located the pusher assembly 24. The pusher assembly is adapted to feed hemmed pocket pieces 38 to a return conveyor section 74 which includes the return conveyor assembly 26.

In a relatively simple overview of the operation of the hemming apparatus described this far, the operator 30 positions a straight edge of one or any number of unhemmed pocket pieces 38 one at a time onto the lower conveyor belts 40, 42, and 44 so that the straight edges thereof abut an elongated positioning stop 76 which is located between conveyor belt 44 and a control display/indicator unit 78.

The pockets may be placed on the conveyor assembly 12 with regular or irregular spacing. The lower conveyor belts 40, 42 and 44 move each pocket piece 38 to the right where the pocket piece 38 is further engaged by the upper conveyor belt 56 where a hem fold is formed in a conventional manner in the folder section 48 by means of the pneumatic tube 54 blowing the outer edge of the pocket under the member 52.

This is followed by sewing a binding tape, not shown, fed to the underside of the hem fold from a spool on the underside of the main conveyor assembly 35 by means of the sewing head 14. Following this, the binding tape is severed from each pocket piece in turn by means of the knife assembly 16, where it is then off loaded from the main conveyor belts 42 and 44 by the unloader assembly 18 where it falls on the flipper assembly 20. The presence of a pocket is sensed, causing the flipper assembly 20 to be activated. The flipper assembly transfers the pocket piece to a stacker assembly 22, which includes a pair of trap doors 80 and 82, which open when a predetermined number of pockets are present, where they drop in a stack to the pusher assembly 24.

When one or more stacks are present in the pusher assembly 24, they are transferred in a bundle to the return conveyor assembly 26, including a relatively wide conveyor belt 84 which moves the bundle of hemmed pockets to an end-stop 86. The conveyor belt 84 is comprised of a material having a relatively low coefficient of friction so as to slide under a bundle of pockets when it reaches the end-stop 86.

In the process, the sewing head 14 and the upper and lower conveyor assemblies 35 and 55 are commonly driven from a single prime mover comprising an electric drive motor 88 located on the frame 10 below the sewing head 14.

Figure 4:
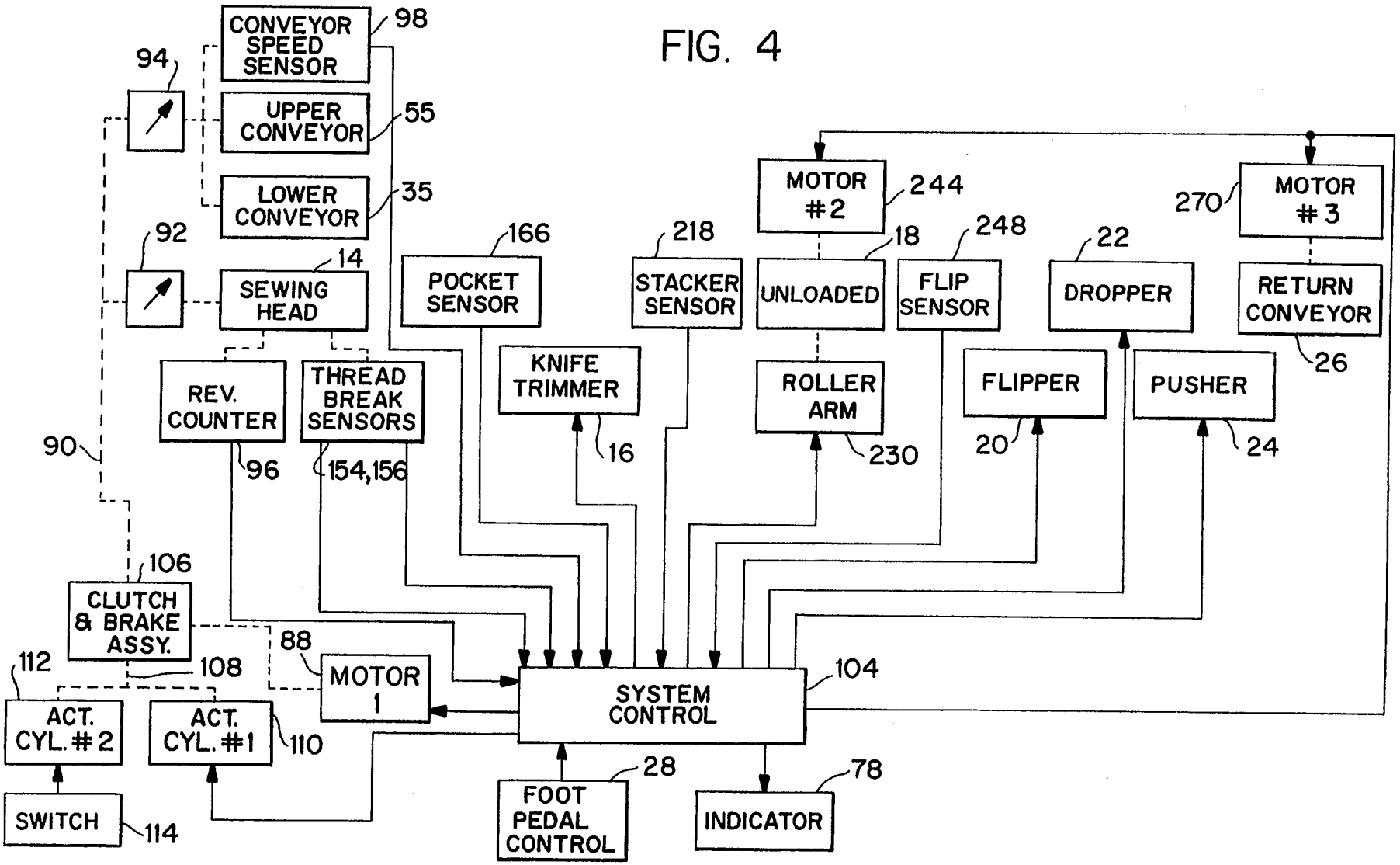
FIG. 4 is a system block diagram illustrative of the invention embodied in the apparatus shown in FIGS. 1 and 2.
Figure 5:
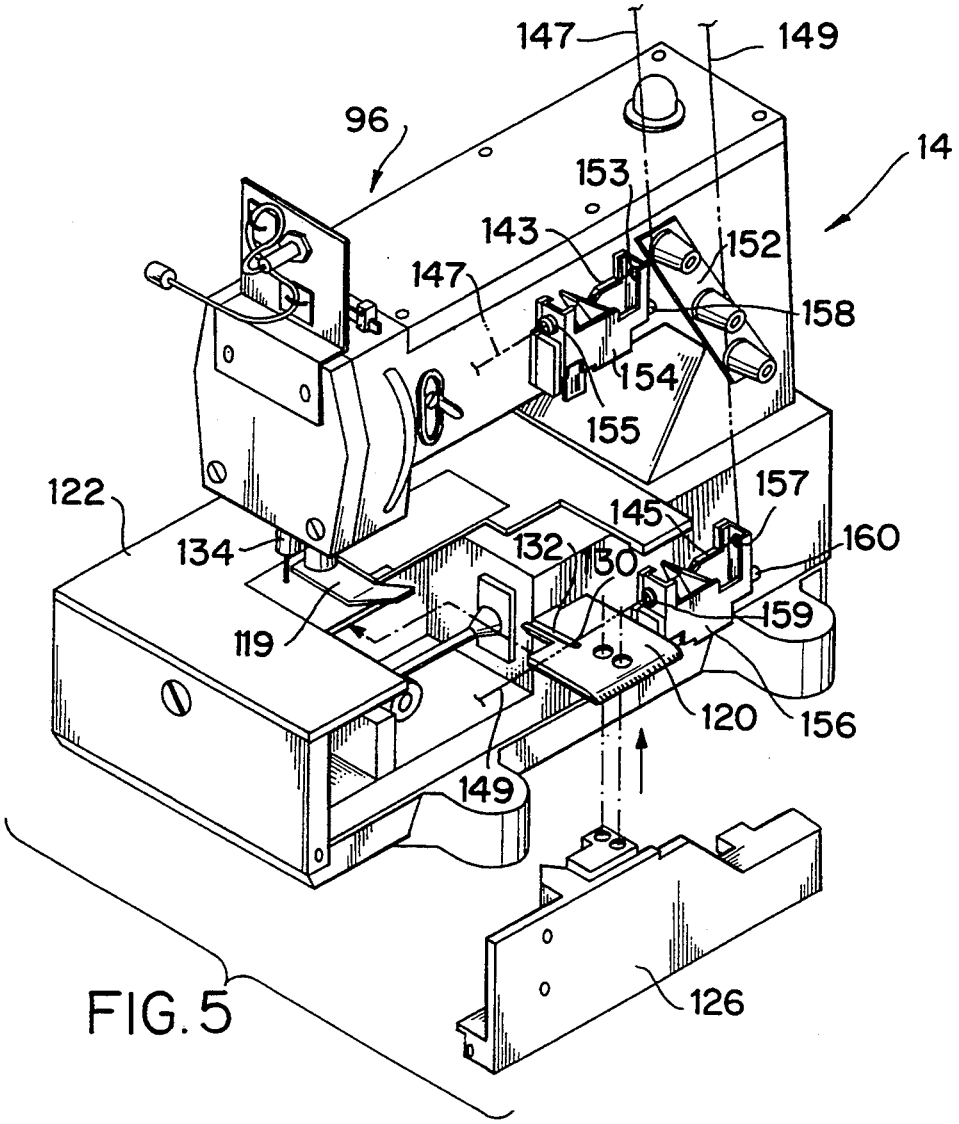
FIG. 5 is an exploded perspective view of the front portion of the sewing head located on the side of the main conveyor.

Coupling therebetween is provided by a drive belt assembly 90 shown schematically in FIG. 4. The belt assembly 90 includes two pitch adjustable sheaves 92 and 94 so as to provide a relative speed adjustment between the sewing head 14 and the upper and lower conveyors 55 and 56. Speed indicators, moreover, are provided both on the sewing head 14 by means of a magnetic type "rev counter" sub-assembly 96, as shown in FIG. 5, and a magnetic conveyor speed sensor sub-assembly 98 shown in FIG. 3, located at the far or unloading end of the conveyor assembly 35 adjacent the two idler rollers 100 and 102 associated with the conveyor belts 42 and 44.

The outputs from the sewing head sensor 96 and the conveyor speed sensor 98 are fed to a microprocessor type system controller 104 shown in FIG. 4 which generates and couples signals indicative of belt speed in inches per second (in/sec) and sewing head speed in revolutions per minute (rpm), the latter also being equal to the number of stitches per minute, since one revolution corresponds to one stitch. The stitch length of the sewing head per revolution is controlled by one or more feed dogs, not shown, as is well known in sewing machine technology. By matching the speed of the conveyor belts 40, 42, 44 and 56 with the speed of the sewing machine 14 by manually adjusting the sheaves 92 and 94, one can determine the number of stitches per inch of conveyor travel from indications of conveyor speed and sewing head speed and correlate an indicated stitch per length reading with an actually physically measured stitch per inch. Any departure between a desired value and an actual value can be manually adjusted during an initial set up operation. Knowing the actual number of stitches per inch of conveyor travel plays an extremely important role in controlling operation of the trimmer knife assembly 16 as will be explained subsequently.

Prior to considering further details of, for example, the sewing head 14 and the knife trimmer assembly 16, it should be noted that the motor 88 includes a clutch and brake assembly, shown schematically by reference numeral 106 in FIG. 4, which permits the operator to manually start and stop a hem stitching operation as well as disengaging a clutch and a brake, not shown, simultaneously in order to manually move the needle bar in the sewing head via manual rotation of a wheel 15 (FIG. 1) located at the rear of the sewing head 14 so that the machine can be easily threaded initially or when a thread break occurs during operation.

Further as schematically shown in FIG. 4, the clutch and brake assembly 106 is mechanically coupled to a three position mechanical motor controller 108 which is operable by a pair of actuator cylinders 110 and 112. The actuator cylinder 110 is controlled by the system controller 104 so that the foot pedal 28 shown in FIG. 1 in the forward position, for example, causes the system controller 104 to actuate the cylinder 110 which is pneumatically driven so as to move the motor controller 108 in a "drive" position wherein the motor brake is off and the clutch is engaged. Release or return of the foot pedal 28 to a second position causes the system controller 104 to move the actuator cylinder 110 to a "stop" position, where the motor drive is halted by energizing the motor brake and disengaging the clutch.

The second actuating cylinder 112 is adapted to place the motor controller 108 in an idle or "neutral" position, where both the motor brake is off and the clutch is disengaged, upon manual actuation of a spring loaded switch 114 located on the side of a switch box 116 located on the machine frame 10 next to the operator as shown in FIGS. 1 and 2. The operator must hold the switch in a down position to place the motor 88 in neutral during which time the operator is able to manually turn the wheel 15 on the rear of the sewing head 14 and thus move the needle bar 117 of the sewing head in order to thread the machine.

A second switch 118 is also located on the control box 116 for controlling the position of the sewing head's presser foot 119 (FIG. 5). Manual operation of the switch 118 causes the presser foot 119 to lift while deactivation causes it to lower. This feature further assists the operator in rethreading the machine.

Turning attention now to FIG. 5, shown thereat is the input side of the sewing head 14. The sewing head 14 in the preferred embodiment of the invention, is comprised of a Rimoldi ® Series 200 sewing machine which has been modified to include a specially designed cloth plate insert 120, the details of which are further shown in FIG. 6. The cloth plate insert 120 is located under the presser foot 119 and forms part of the cloth plate 122 and is secured to a binding tape guide 124 which is part of a front door member 126.

Figure 6:
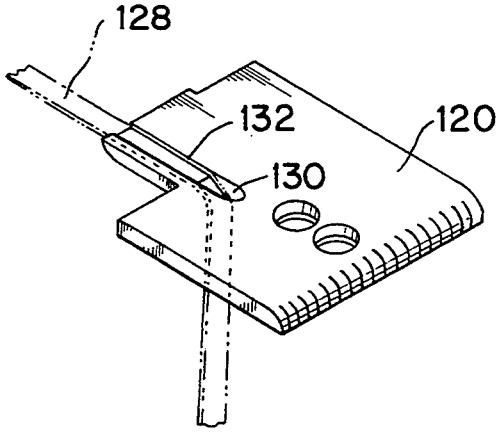
FIG. 6 is an enlarged perspective view of the cloth plate insert shown in FIG. 5.

A continuous web of back binding tape 128 fed from a spool, not shown, located beneath the conveyor 35 feeds up along the tape guide 124 where it enters an angulated aperture 130 in the cloth plate insert 120 as best shown in FIG. 6, where it is then fed horizontally in a linear slot 132 toward and under one or more sewing needles, illustrated as a single needle 134 for purposes of illustration, and which is located between the presser foot 119 and feed dogs, not shown, for moving both the binding tape and an overlaying hem fold of a pocket member to the left to the separation section 72 including the trimmer knife assembly 16.

The sewing head "rev counter" 96 is shown in FIG. 5 being attached to the top forward section of the sewing head 14 and is adapted to sense the up and down movement of the needle bar 117 holding the sewing needle 134. Thread is fed from two spools 138 and 140 shown located on a feeder assembly including a pair of spool holders 142 and 144 and one or more feeder bars, for example, bars 146, 148 and 150 containing a plurality of eyelets 151. Two or more separate strands of sewing thread 147 and 149 pass over the sewing head 14 and through a thread tensioning sub-assembly 152 mounted on the side of the sewing head. The two threads exit the thread tensioning sub-assembly 152 and, respectively, pass through a pair of thread-break sensors 154 and 156 which are also mounted on the side of sewing head 14 forward of the thread tensioning sub-assembly 152.

A pair of spacer members 143 and 145 are furthermore positioned between the sensors 154 and 156 and the side wall of the sewing head 14. The spacer members 143 and 145 provide electrical insulation between the parts as well as suppressing vibration originating in the sewing head due to the fact that the thread break sensors 154 and 156 comprise piezoelectric type sensors that sense the vibration of the threads 147 and 149 passing through the devices between pairs of grommets 153, 155 and 157, 159. The thread break sensors comprise Model No. 20101735 thread break sensor units manufactured by AMP Corporation.

Each of the thread-break sensors 154 and 156 generate electrical output signals which are coupled to the system controller 104 (FIG. 4). The sensors, moreover, are modified to include respective light emitting diodes 158 and 160 which act as visual indicators and which are adapted to be illuminated by the system controller 104 in response to a thread break of the thread passing both to the needle 134 and a looper mechanism, not shown, located internally below the cloth plate 122 and beneath the needle 134.

When desired, the sewing mechanism shown in FIG. 5 can be converted to a double stitch configuration, depending upon the specific task required.

Figure 7:
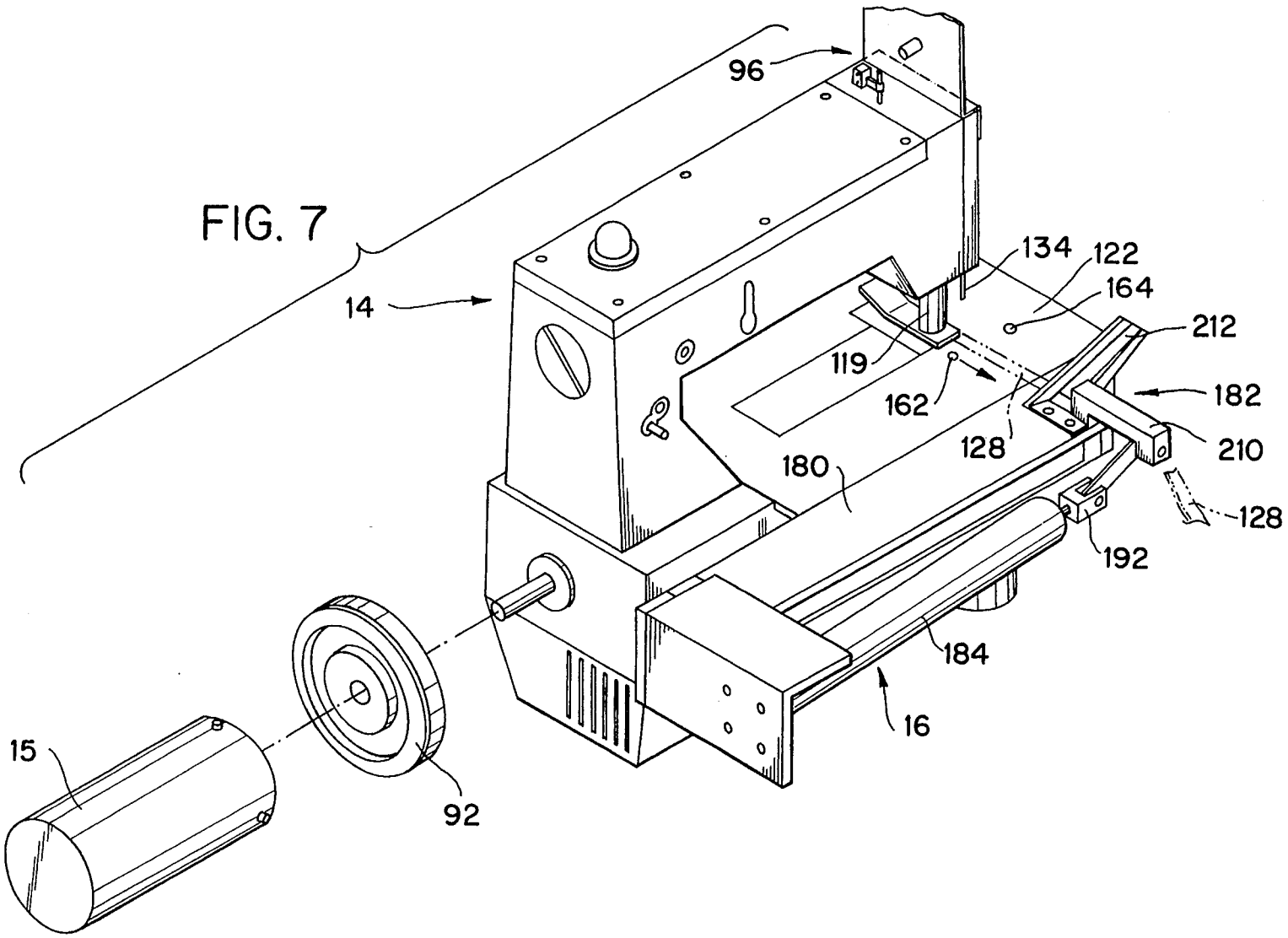
FIG. 7 is a perspective view further illustrative of the sewing head and now additionally also being illustrative of a pocket trimmer knife assembly adjacent thereto.
Figure 8:
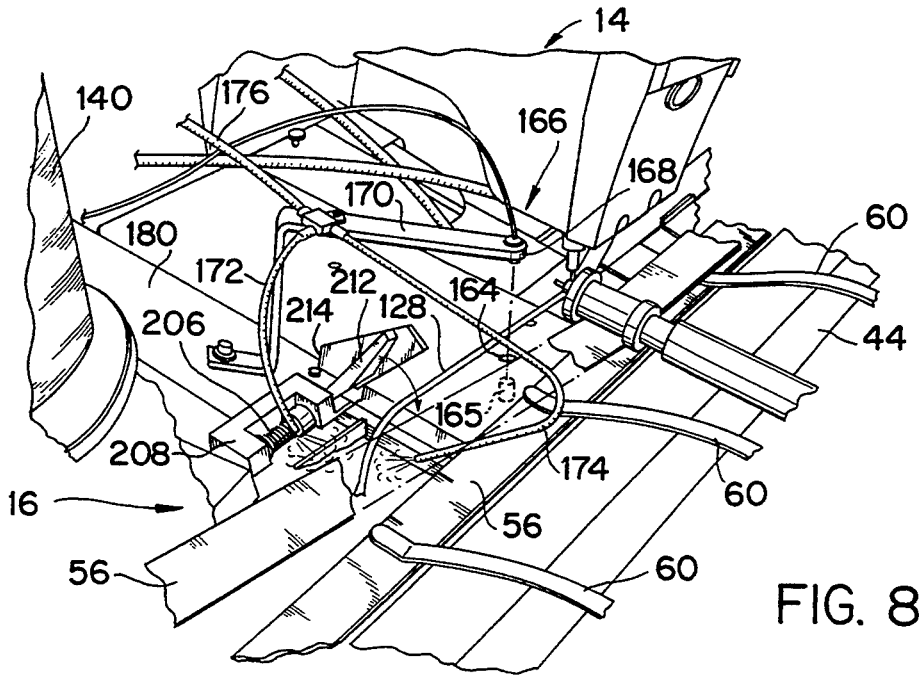
FIG. 8 is a partial cutaway view illustrative of the binder tape and pocket sensor associated with the sewing head and trimmer knife assembly shown in FIG. 7.
Figure 11:
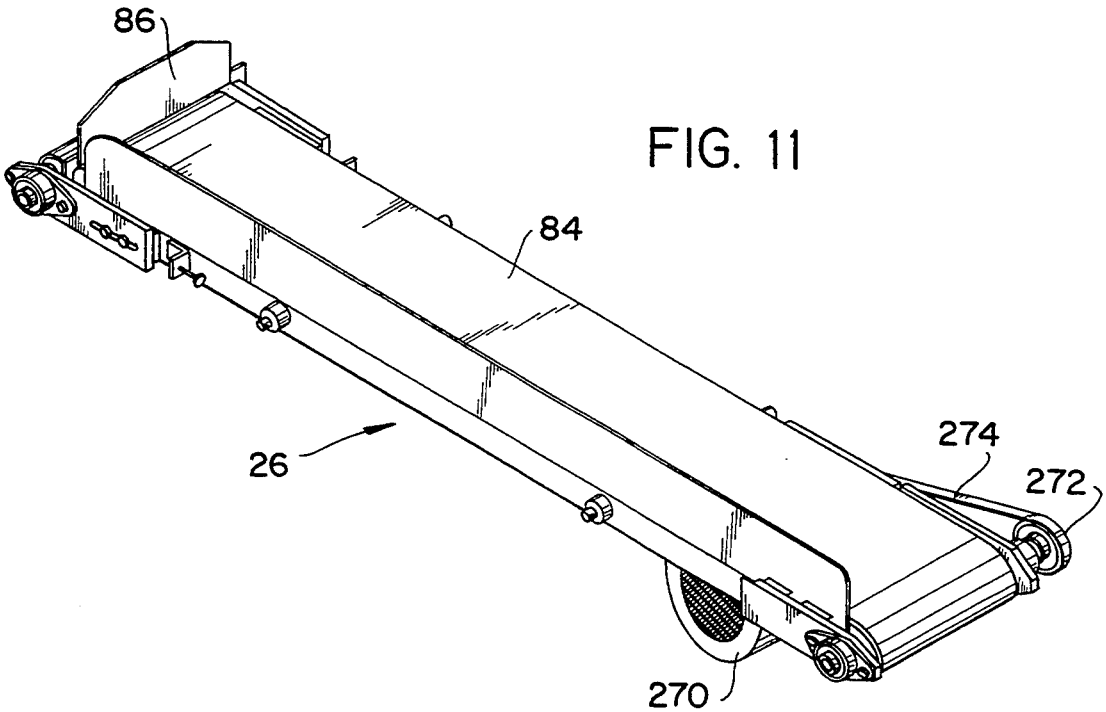
FIG. 11 is a perspective view of the return conveyor assembly shown in FIGS. 1 and 2.

Turning attention now to FIGS. 7 and 8, shown thereat is the output side of the sewing head 14 with the trimmer assembly 16 secured thereto. Before discussing the trimmer assembly, it should be noted that there is an air hole 162 located in the cloth plate 122 adjacent the presser foot 119 which is connected to a pneumatic source, not shown. The air flow is angulated away from the presser foot 119 as shown to direct the back binding tape 128 shown in FIG. 5 toward the trimmer assembly 16. It should also be noted that there is an additional hole or aperture 164 in the cloth plate 122 adjacent the air hole 162 and below which is mounted an infra-red light emitting diode 165 which forms part of a pocket sensor sub-assembly 166.

The pocket sensor 166 also includes an infra-red detector diode 168 mounted on the end of a swivable angle bracket 170 secured to the knife trimming assembly 16. The pocket sensor assembly 166 acts to detect the forward and trailing edge of a pocket piece 38 being transported via the upper and lower conveyor belts 42 and 56 from the sewing head 14 as well as any back binding tape 128 or a double knit chain of thread being fed off of the cloth plate insert 120 shown in FIG. 6. Also, mounted on the angle bracket 170 is a pair of air tubes 172 and 174 which are coupled to a pneumatic supply line 176. As shown, the tubes 172 and 174 straddle the upper conveyor belt 56 and are pointed downwardly for the purposes of delivering air to the region where the tape 58 is severed by the trimming knife assembly 16 so as to blow the tailings down into a receiving bin, not shown.

In operation, when an infra-red light beam passing between the LED diode 168 and its associate receptor located beneath the hole 164 is interrupted, the system controller 104 operates to count the number of stitches being made by the sewing head 14 by sensing the output of the "rev counter" 96. By knowing the travel conveyor speed in stitches per inch as previously determined during a set up operation, the system controller determines the travel distance between the IR detector aperture 164 and the knife trimmer assembly 16 for actuating a cutting operation.

Referring now to the details of the trimmer knife assembly 16, reference will now be made collectively to FIGS. 9A and 9B. There reference numeral 180 designates an L-shaped base for supporting a scissor type cutting head sub-assembly 182 at the forward portion thereof coupled to a double acting pneumatic piston 184. As shown, the piston 184 includes a pneumatic rear and forward coupling 186 and 188 so that a piston rod 190 can be driven positively in both the forward and reverse direction upon selective application of a pneumatic driving force. The piston rod 190 is attached to a clevis member 192 including a pivot pin 194 to which is attached a pair of diverging links 196 and 198 which respectively connect to a drive rod clamp lock 200 and a fixed pivot block 202. The pivot block 202 is secured to the base 180 at the forward end as shown. The clamp block 200 is secured to a rod 204 which passes through a compression knife blade bias spring 206 which is located between a shaft collar 208 and a U-shaped block 210. At the outer extremity of the rod 204 is attached an upper rotatable blade member 212 and an adjoining knife lubricating pad 214. Associated with the upper blade member 212 is a fixed lower blade member 216 which is secured to the forward portion of the base member 180.

In operation, application of pneumatic pressure to the rear coupling 186 will drive the piston rod 190 forward causing the links 196 and 198 to move from the position shown to an opposite angulated position as shown in dotted lines upon full travel of the piston. As the upper link 198 rotates clockwise, the upper blade member 212 begins a downward stroke. At the point where two links 196 and 198 are in alignment, the upper blade member 212 meets the lower blade member 216 to thereby cut any material passing the point where the blades meet. As the links 196 and 198 continue to rotate, the upper blade 212 again raises up to a rest position as shown in FIG. 9B. Thereafter, when pneumatic pressure is applied to the forward coupler 188, the piston rod 190 is driven rearwardly, causing the links 196 and 198 to return to their original position, but in doing so, the upper blade 212 makes another cut. Thus for a complete forward and back motion of the piston rod 190, two complete downward cuts will be made by the trimmer assembly 16.

The double acting scissors type mechanism utilized in connection with the trimmer assembly 16 results in an extremely fast acting knife structure that can sever binding tape 128 (FIG. 5) sewn to pockets 38 (FIG. 2) which are not only positioned extremely closely together but relatively far apart as well. Where pockets 38 are positioned relatively close to one another, a single cut of the tape 128 is made between successive pocket pieces. However, if there is considerable spacing between pockets coming from the sewing head 14, the controller responds to the pocket sensor assembly 116 to sever the back binding tape 128 on the leading edge and the trailing edge of each respective pocket. This again results from sensing the leading and trailing edges of the pocket as they pass the IR sensor aperture 164 (FIG. 7) and counting the stitches made in the sewing head 14 so as to determine the distance to the location of the cutting blades 212 and 216.

As the hemmed pockets 38 leave the trimmer knife assembly 16 under the control of the upper and lower conveyor belts 56, and 42, as well as the lower conveyor belt 44, they leave the end of the upper conveyor belt 68 at the location of the idler wheel 68 and continue onward until an IR stacker sensor assembly 218 is reached.

Figure 10:
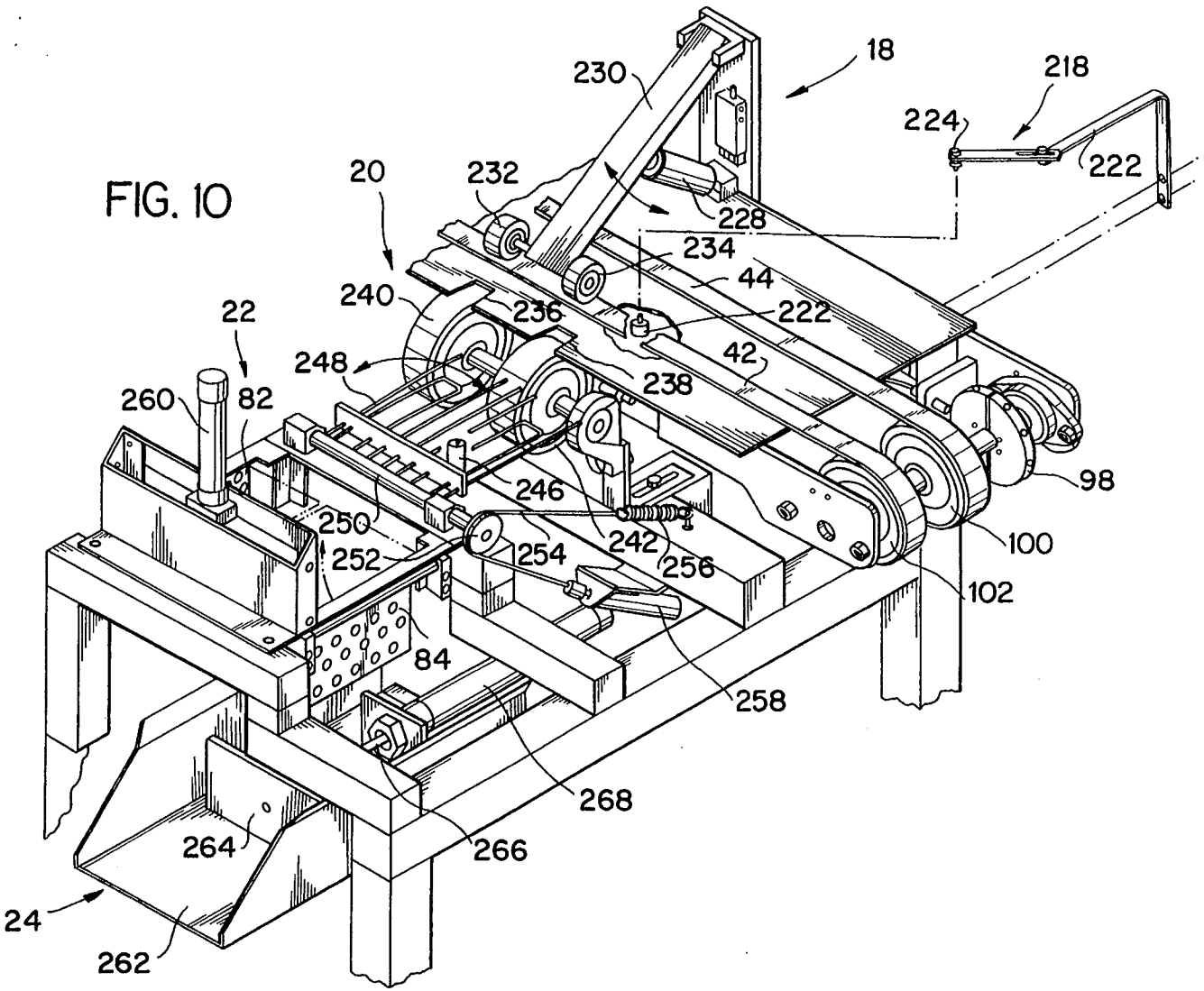
FIG. 10 is a partial perspective view illustrative of the details of the pocket unloader assembly located at the end of the conveyor shown in FIGS. 1 and 4 and additionally including the details of the conveyor speed sensor located thereat.

Referring now to FIG. 10, the sensor assembly 218 consists of a swivable angle bracket 220 secured to the frame 10 and extends over the conveyor table 34. At the end of the angle bracket 220, there is located another IR detector 222 which is positioned over a small aperture 224 in the conveyor table 34 above an IR LED 226. Interruption of a light beam between LED 226 and the detector 222 by a pocket piece 38, not shown, is sensed and a signal generated thereby is coupled to the system controller 104 which in turn activates a pneumatic cylinder 228 containing an extended piston rod 229. The piston rod 229 retracts to move the pocket off the main conveyor assembly 12 by lowering a roller arm 230 containing a pair of small idler rollers 232 and 234 over two slots 236 and 238 in the conveyor table 34 under which are located a pair of larger unloader rollers 240 and 242 which are powered by a continuously running motor 244 independently energized through the system controller 104.

When a hemmed pocket part 38 is unloaded from the conveyor belts 42 and 44 via the unloader mechanism 18, the pocket is transferred to a flipper sub-assembly 20 under which is located a pocket flipper sensor 246. A wire type flipper 248 is connected to an axle member 250. The end of the axle terminates in a small sprocket 252. A chain 254 wraps around the sprocket 252 and terminates at one end in a tension spring 256 and at the other end in a pneumatic piston 258. In response to an electrical signal being generated by the flipper sensor 246, when a hemmed pocket is delivered to the flipper 248, the pneumatic cylinder 258 is actuated, causing the flipper 248 to rotate 135°, thereby delivering the hemmed pocket located in the flipper to the pair of trap doors 80 and 82 shown in the plan view of FIG. 2. The action of the spring 256 then returns the flipper member 248 to its rest position.

The system controller 104 (FIG. 4) counts the number of pockets stacked on the trap doors 80 and 82 of the dropper assembly 22, and after a predetermined count a pneumatic cylinder 260 is activated which opens the trap doors 80 and 82. The stack of hemmed pockets then fall vertically onto the tray 262 of the pusher assembly 24 which also includes a pneumatically actuated push plate 264 coupled to the piston rod 266 of a pneumatic cylinder 268.

When one or more stacks of hemmed pockets are present on the tray 262, the cylinder 268 under the control of the system controller 104 is activated. The push plate 264 then delivers one or more stacks of hemmed pockets in a bundle to the conveyor belt 84 of the return conveyor 26 which is intermittently driven long enough to deliver a bundle to the end stop 86 by a third electrical drive motor 270 (FIG. 4). As previously described, a bundle of hemmed pockets are then returned to the operator 30 shown in FIG. 4 where they come to rest for removal at the end stop 86.

Thus what has been shown and described is an improved automatic hemming machine, which in addition to including several innovative features, is capable of improving the production rate of hemmed pockets by a factor of two over conventional pocket hemming apparatus.

Having thus shown and described what is at present considered to be the preferred embodiment of the invention, it is to be noted that the same has been made by way of illustration and not limitation. Accordingly, all changes, modifications and alterations coming within the scope of the invention as set forth in the appended claims are herein meant to be included.

What is claimed is:

1. Apparatus for automatically hemming pocket pieces, comprising:

a main conveyor belt assembly located on a conveyor table and including at least two relatively narrow parallel lower conveyor belts and a pair of relatively narrow opposing intermediate conveyor belts comprising an upper and lower belt located between the two lower conveyor belts for holding pocket pieces in place when placed thereon by an operator;

means for biasing the upper intermediate conveyor belt downwardly against the opposing lower intermediate conveyor belt;

a drive motor coupled to the main conveyor belt assembly for moving all of said conveyor belts in unison at the same speed;

means on the main conveyor belt assembly located at a folder section for forming a hem fold in each of said pocket pieces after being placed on said conveyor belt assembly at a lay up section;

a sewing head located at a hemming section and being coupled to the drive motor and operated in synchronism with the main conveyor belt assembly for sewing a length of back binding tape on the hem fold of the pocket pieces;

means located at said hemming section for sensing the back binding tape or a leading and trailing edge of said pocket pieces following the length of back binding tape being sewn thereto;

cutting means located at a separation section for severing the back binding tape and any thread at the leading and trailing edge of each pocket piece;

means located on said main conveyor belt assembly for sensing the speed of said conveyor belts;

means located on said sewing head for sensing the sewing speed of the sewing head;

system control means coupled to said speed sensing means for determining the distance of said leading and trailing edges to said cutting means as a function of the sewing speed and speed of said conveyor belts and thereafter actuating said cutting means following a sensing of the binding tape or the leading and trailing edges of a pocket piece;

means located at an end section of the conveyor table for transferring hemmed pocket pieces off of said main conveyor belt assembly; and a return conveyor belt assembly located at a return conveyor section adjacent said end section for receiving hemmed pocket pieces from said transferring means and returning the hemmed pocket pieces back to the operator for removal.

2. The apparatus as defined by claim 1 wherein said return conveyor belt assembly includes a conveyor belt having a predetermined coefficient of friction permitting pocket pieces to slide thereon when said pocket pieces abut an end stop.

3. The apparatus as defined by claim 1 wherein one of said two lower conveyor belts and the lower intermediate conveyor belt extend the length of the conveyor table and the other one of said two lower conveyor belts extends from the lay up section end of the conveyor table to the folder section.

4. The apparatus as defined by claim 3 and wherein said upper intermediate conveyor belt extends from the folder section to a stacker section.

5. The apparatus as defined in claim 1 and additionally including means for feeding and guiding said binding tape beneath the hem fold of a pocket piece located at said sewing head.

6. The apparatus as defined by claim 5 wherein said means for feeding and guiding includes a cloth plate insert located in a cloth plate member in front of a presser foot of said sewing head, said cloth plate insert having an angulated slot formed through the thickness dimension thereof and a linear slot formed in an upper surface thereof directed to a sewing region of the sewing head and extending to said angulated slot for translating back binding tape from a source of binding tape to the sewing head.

7. The apparatus as defined by claim 6 wherein said means for feeding and guiding additionally includes a slot in a front machine cover oriented at a substantially right angle to said cloth plate insert for feeding said binding tape up to said angulated slot in the cloth plate insert.

8. The apparatus as defined by claim 6 and additionally including pneumatic means located in relatively close proximity to the sewing region for directing the binding tape leaving the sewing head toward said cutting means.

9. The apparatus as defined by claim 8 wherein pneumatic means comprises an air hole located in said cloth plate.

10. The apparatus as defined by claim 1 wherein said sewing head additionally includes thread break sensor means and indicator means mounted thereon for providing a visual indication to said operator of a break in a sewing thread being fed to the sewing head.

11. The apparatus as defined by claim 10 wherein said thread break sensor means comprises a pair of piezoelectric thread break sensors responsive to vibration of thread passing through the respective sensors and additionally including vibration isolation and electrical insulation mounting means between the sewing head and said piezoelectric thread break sensors.

12. The apparatus as defined by claim 11 and wherein said indicator means comprises light emitting means mounted on each of said pair of thread-break sensors.

13. The apparatus as defined by claim 12 wherein said light emitting means comprises a light emitting diode.

14. The apparatus as defined by claim 1 wherein said cutting means operates such that if said pocket pieces are spaced relatively close to one another on said main conveyor belt assembly, the cutting means is actuated only once between pocket pieces by said system control means to ensure the slightest margin of binding tape outside of the edges of two adjacent pocket pieces and if said pocket pieces are spaced by more than a predetermined distance, the cutting means is actuated twice by said system control means, thus separately trimming the respective trailing and leading edges of successive pocket pieces.

15. The apparatus as defined by claim 14 and wherein said cutting means comprises a pneumatically driven scissors type knife assembly.

16. The apparatus as defined by claim 15 wherein said knife assembly comprises a movable knife member, a stationary knife member, a movable knife actuator, and a base for supporting the stationary knife member and the actuator, the actuator further comprising a pneumatic cylinder including a piston and having a pneumatic coupling at each end for alternately receiving a pneumatic driving force under the control of said system control means, said pneumatic cylinder having a piston rod located therein connected at one end to the piston and at the other end to linkage means coupled to the movable knife member which is driven downwardly to make a cut with the stationary knife member for each forward and return stroke of the piston rod.

17. The apparatus as defined by claim 16 and additionally including spring bias means for urging said movable knife member into contact with said stationary knife member while making a cut.

18. The apparatus as defined by claim 17 wherein said other end of said piston terminates in a clevis member pivotally coupled to said linkage means, and wherein said linkage means comprises a bifurcated linkage including a pair of pivotal links, one link of said pair being pivotally coupled to said base and one link being pivotally coupled to said movable knife member.

19. The apparatus as defined by claim 15 and additionally including means located at said cutting means for blowing unused cut portions of said binding tape away from said knife assembly.

20. The apparatus as defined by claim 1 wherein said means located at said hemming section for sensing the back binding tape or the edge of the pocket pieces comprises electro-optical sensing means.

21. The apparatus as defined by claim 20 wherein said electro-optical sensing means comprises an aperture in the conveyor table intermediate the sewing head and the cutting means and means located above and below the conveyor table in substantial alignment with said aperture for generating and detecting light energy, said means for detecting light energy generating an electrical signal coupled to the system control means in response to interruption of a light beam passing through said aperture between said light energy generating means and said light detecting means.

22. The apparatus as defined by claim 21 wherein said light generating means comprises an infra-red device.

23. The apparatus as defined by claim 22 wherein said infra-red device comprises an infra-red light emitting diode.

24. The apparatus as defined by claim 1 wherein said means located at the end section for transferring hemmed pocket pieces includes means for sensing the arrival of a hemmed pocket piece on said main conveyor off of said main conveyor belt assembly, a stacker assembly located adjacent said moving means for receiving and stacking a predetermined number of hemmed pocket pieces, and means for receiving at least one stack of hemmed pocket pieces and transferring said stack to said return conveyor belt assembly.

25. The apparatus as defined by claim 24 wherein said means for sensing the arrival of a hemmed pocket piece comprises electro-optical sensing means.

26. The apparatus as defined by claim 25 wherein said electro-optical sensing means comprises an aperture in the conveyor table located a predetermined distance past the upper intermediate conveyor belt and means located above and below the conveyor table in substantial alignment with said aperture for generating and detecting light energy, said means for detecting light energy generating an electrical signal coupled to the system control means in response to interruption of a light beam passing through said aperture between said light energy generating means and said light detecting means.

27. The apparatus as defined by claim 26 wherein said light generating means comprises an infra-red device.

28. The apparatus as defined by claim 27 wherein said infra-red device comprises an infra-red light emitting diode.

29. The apparatus as defined by claim 24 wherein said means for moving a pocket piece off of said main conveyor belt assembly comprises at least one opening in a longitudinal edge of the conveyor table, at least one motor driven wheel located under the conveyor table and having a perimeter surface projecting up into said opening, and a pivotally mounted pocket engaging arm member located above the conveyor table and being coupled to actuator means operated in response to a hemmed pocket piece being present at said sensing means for lowering the arm member to the conveyor table to engage the pocket piece whereupon said wheel laterally moves the hemmed pocket piece off of the main conveyor belt assembly.

30. The apparatus as defined by claim 24 wherein said stacker assembly includes means for feeding a hemmed pocket piece onto means for holding and subsequently dropping a predetermined number of hemmed pocket pieces in a stack to said means for receiving and transferring the stack to the return conveyor belt assembly.

31. The apparatus as defined by claim 30 wherein said means for feeding comprises a flipper mechanism and additionally including sensor means located adjacent the flipper mechanism for sensing a hemmed pocket piece on the flipper mechanism, said sensor means generating a signal coupled to said system control means for actuating the flipper mechanism, causing the pocket piece to be turned over and placed face down on said means for holding and dropping.

32. The apparatus as defined by claim 31 wherein said means for holding and dropping comprises a trap door mechanism actuated by said system control means in response to a predetermined number of hemmed pocket pieces being fed to said trap door mechanism.

33. The apparatus as defined by claim 32 wherein said trap door mechanism includes a pair of rotatable doors located over said means for receiving and transferring the stack to the return conveyor belt assembly.

34. The apparatus as defined by claim 33 and additionally including actuator means coupled to said pair of rotatable doors and controlled by said system control means for opening and closing said doors.

35. The apparatus as defined by claim 34 wherein said actuator means comprises pneumatic actuator means controlled by said system control means.

36. The apparatus as defined by claim 24 wherein said means for receiving and transferring said at least one stack of hemmed pocket pieces comprises a tray for receiving said stack of hemmed pocket pieces and a pusher member translatable in said tray and actuated from said system control means to push said at least one stack of hemmed pocket pieces onto said return conveyor belt assembly.

37. The apparatus as defined by claim 36 and additionally including actuator means coupled to said pusher member and controlled by said system control means for moving said pusher member forward and backward.

38. The apparatus as defined by claim 37 wherein said actuator means comprises pneumatic actuator means.

39. The apparatus as defined by claim 1 wherein said drive motor includes a clutch and a brake and additionally including first pneumatic means operable by said operator for setting the brake and disengaging the clutch in a stop mode of operation and for releasing the brake and engaging the clutch in a run mode of operation and second pneumatic means for releasing the brake and disengaging the clutch in a neutral mode of operation whereby the operator can manually move the sewing head with relative ease during a sewing head rethreading operation.

40. The apparatus as defined by claim 39 wherein said first means includes a foot pedal located at the lay up section and said second means includes a manually operated switch device located adjacent the sewing head.

41. The apparatus as defined by claim 40 and additionally including another manually operated switch device located adjacent the sewing head for aiding said rethreading operation.

* * * * *